US010051938B1

(12) United States Patent
Kim

(10) Patent No.: US 10,051,938 B1
(45) Date of Patent: Aug. 21, 2018

(54) METHOD OF MANUFACTURING NAIL FILE

(71) Applicant: DAEIL BEAUTY COLLECTION CO., LTD., Incheon (KR)

(72) Inventor: Youngpill Kim, Incheon (KR)

(73) Assignee: DAEIL BEAUTY COLLECTION CO., LTD., Incheon (KR)

( * ) Notice: Subject to any disclaimer, the term of this patent is extended or adjusted under 35 U.S.C. 154(b) by 0 days.

(21) Appl. No.: 15/699,039

(22) Filed: Sep. 8, 2017

(30) Foreign Application Priority Data

Mar. 31, 2017 (KR) ..... 10-2017-0041489

(51) Int. Cl.
*A45D 29/12* (2006.01)
*B24D 3/00* (2006.01)
*B24D 18/00* (2006.01)

(52) U.S. Cl.
CPC ..... *A45D 29/12* (2013.01); *B24D 3/00* (2013.01); *B24D 18/0054* (2013.01)

(58) Field of Classification Search
CPC ..... A45D 29/12; B24D 18/0054; B24D 3/00
See application file for complete search history.

(56) References Cited

U.S. PATENT DOCUMENTS 4,422,465 A * 12/1983 Haga ..... A45D 29/04 132/76.4
2009/0235944 A1* 9/2009 Cha ..... A45D 29/04 132/76.4

FOREIGN PATENT DOCUMENTS

KR 20100107940 10/2010

* cited by examiner

*Primary Examiner* — Xiao S Zhao
(74) *Attorney, Agent, or Firm* — IPLA P.A.; James E. Bame

(57) ABSTRACT

A nail file manufacturing method including: dissolving powder particles in a prepared BC solution; mixing liquefied powder obtained from the powder particles dissolving step with an epoxy resin; applying a mixture obtained from the epoxy resin and powder mixing step to upper and lower surfaces of a plate by a rolling method; first firing the plate obtained from the application step by heating the plate at 150° C. for 10 to 15 seconds; spreading abrasives in a range from 150 mesh to 320 mesh to each of the upper and lower surfaces of the plate obtained from the first firing step; second firing the plate obtained from the abrasives spreading step at a temperature range of 190° C. to 200° C. for 12 minutes; and coating the upper and lower surfaces of the plate obtained from the second firing step with a thin epoxy resin.

13 Claims, 3 Drawing Sheets

METHOD OF MANUFACTURING NAIL FILE

CROSS REFERENCE

The present application claims priority to Korean Patent Application No. 10-2017-0041489, filed 31 Mar. 2017, the entire contents of which is incorporated herein for all purposes by this reference.

BACKGROUND

The present invention relates generally to a method of manufacturing a nail file for nail shaping and polishing. More particularly, the present invention relates to a method of manufacturing a nail file, in which abrasives are evenly distributed on and adhered to a surface of a base plate made of glass or a thin iron sheet to be prevented from being stripped off the surface of the plate, and are adhered to the surface of the base plate made of glass at an even height, thereby increasing nail shaping and polishing capabilities and reliability of products.

Generally, a nail beauty tool or a nail polishing tool refers to a tool for beautifying nails by filing cut tips of long nails or polishing surfaces of nails to express a gloss.

It has been known that this nail polishing tool is obtained by a process such as: sanding a metal plate or a synthetic resin material having a certain thickness, chemically corroding a metal plate to make uneven on a surface of the plate, or attaching sandpaper or a strip material on a surface of a synthetic resin plate using glue.

In the case of the sanding process to make an uneven surface, there are problems that a uniform and regular surface cannot be obtained, and the manufacturing cost increases since an additional sanding machine should be used.

In the case of the chemical corrosion method to make an uneven surface on a metal plate, there are problems that it is unable to produce a nail beauty tool having a constant hardness, nail shaping and polishing capabilities decrease due to wear caused by repetitive use, and a surface of the tool is generally plated with heavy metal so that it may be harmful to human bodies.

As an attempt to solve the above problems, a technique in which means of abrasion is provided on a surface of glass has been proposed, as disclosed in Korean Patent No. 10-1074368 entitled 'nail file and manufacturing method thereof'.

In the case of the conventional art of manufacturing a nail file, two methods are generally used: forming hatching grooves for abrasion on existing metal, and attaching abrasives on surfaces of a file. The two methods intend to overcome limited service life and to allow a user to easily clean the nail file. The nail file comprises a long plate shape body including a taper part gradually narrowed in one end, and a filing surface for abrasion on one of upper and lower surfaces. The nail file is provided such that the body is made of tempered glass and the filing surface is formed with multiple fine circular grooves in a rectangular arrangement, and the boundary of the multiple fine circular grooves are stepped.

The technique is about forming fine circular grooves in a rectangular arrangement on a surface of tempered glass. The technique is to form grooves on the tempered glass surface layer, and comprises: a photo-masking step of forming fine circles in a rectangular arrangement on the tempered glass plate with an anticorrosion liquid to prevent a remaining part excluding circular grooves from corrosion, an etching step of forming circular grooves by a corrosion liquid, a cutting step of cutting the tempered glass in a needed shape, and a cleaning step of cleaning the cut nail file. Through the technique, the tempered glass nail file having fine circles in a rectangular arrangement is provided.

However, since the technique includes the corrosion of the tempered glass surface and the masking with photomask in the remaining part with the anticorrosion liquid preventing corrosion except the circular grooves which should be corroded, rigidities of corroded circular grooves and the remaining part on the tempered glass plate are different from each other. Thus, it is inevitable to have nonuniform hardness of the entire tempered glass, and to form crack in case of applying impact to grooves even when small impact is applied thereto. Therefore, there is a possibility the service life of the nail file may be shorter than that of existing nail polishing tools.

Accordingly, keeping in mind the above problems occurring in the related art, abrasives and the like may be attached to the surface of a plate. To realize this object, there are methods such as mixing abrasives with glue and applying the mixture to the surface of an abrasive plate mainly made of synthetic resin material, or attaching an abrasive paper having abrasives to the surface of the plate, but a method of attaching abrasives to a surface of glass has not yet been proposed In the case of attaching the abrasive paper to the surface of a plate made of glass, the adhesion is only temporary even when the abrasive paper is attached to glass. In particular, cleaning the nail file in water after use may decrease a service life thereof remarkably, therefore the attaching of the abrasive paper to the surface of a glass plate is not good solution.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and the present invention is intended to provide a nail file that prolongs a service life thereof by preventing abrasives from being stripped off a surface of glass used as a plate without corrosion on the surface thereof, and to obtain a nail file having excellent nail shaping and polishing capabilities.

In order to achieve the above object, according to one aspect of the present invention, there is provided a method of manufacturing a nail file, the method comprising: a powder particles dissolving step S10 of dissolving powder particles in a prepared BC solution; an epoxy resin and powder mixing step S20 of mixing liquefied powder obtained from the powder particles dissolving step S10 with an epoxy resin; an application step S30 of applying a mixture obtained from the epoxy resin and powder mixing step S20 to upper and lower surfaces of a plate by a rolling method; a first firing step S40 of firing the plate obtained from the application step S30 by heating the plate at 150° C. for 10 to 15 seconds; an abrasives spreading step S50 of spreading abrasives in a range from 150 mesh to 320 mesh to each of the upper and lower surfaces of the plate obtained from the first firing step S40; a second firing step S60 of firing the plate obtained from the abrasives spreading step S50 at a temperature range of 190° C. to 200° C. for 12 minutes; and an epoxy resin coating step S70 of coating the upper and lower surfaces of the plate obtained from the second firing step S60 with a thin epoxy resin.

According to the present invention, the present invention prevents abrasives from being stripped off the surface of glass or a thin iron sheet used as the plat without corrosion on the surface of the plate, thereby it is capable of prolonging the service life of a product and obtaining a product having excellent nail shaping and polishing capabilities.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
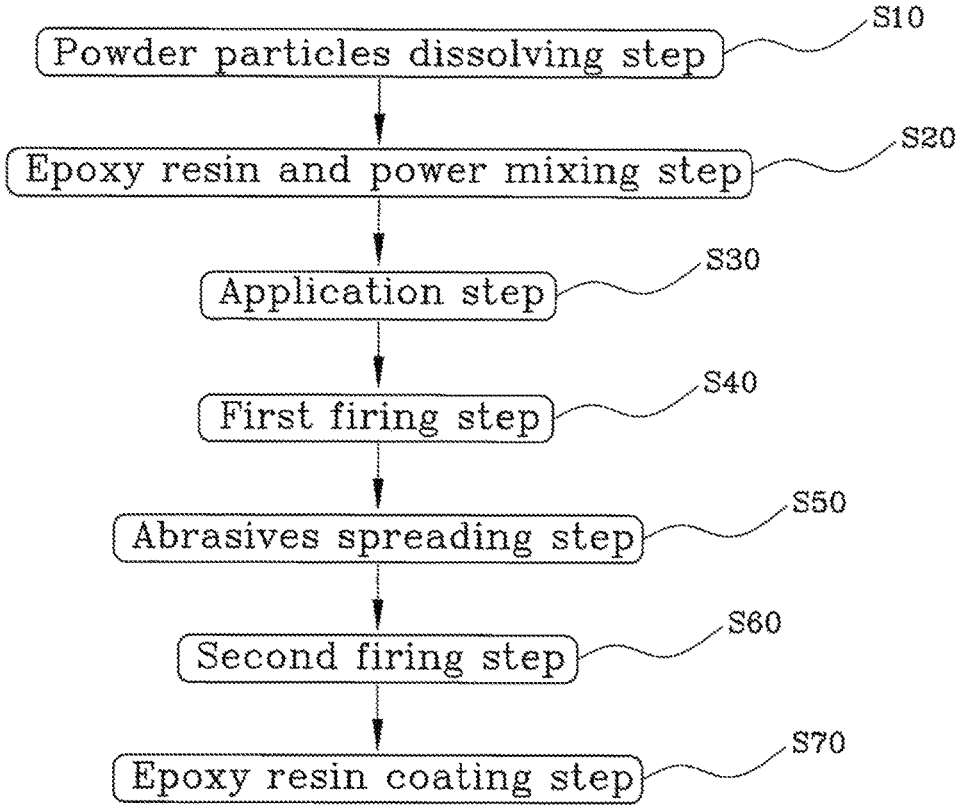
FIG. 1 is a flow diagram illustrating a process according to a first embodiment of the present invention.
Figure 2:
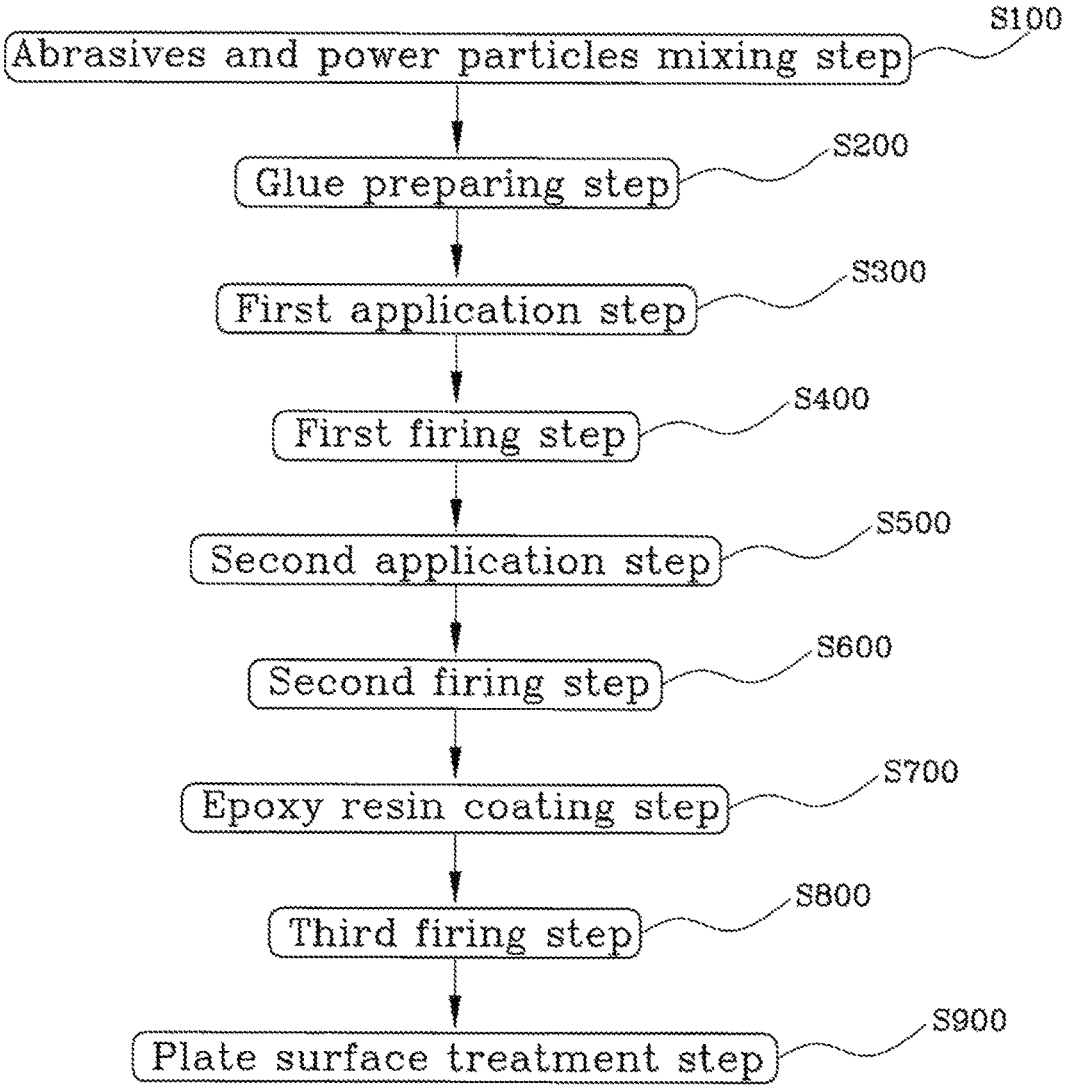
FIG. 2 is a flow diagram illustrating a process according to a second embodiment of the present invention.
Figure 3:
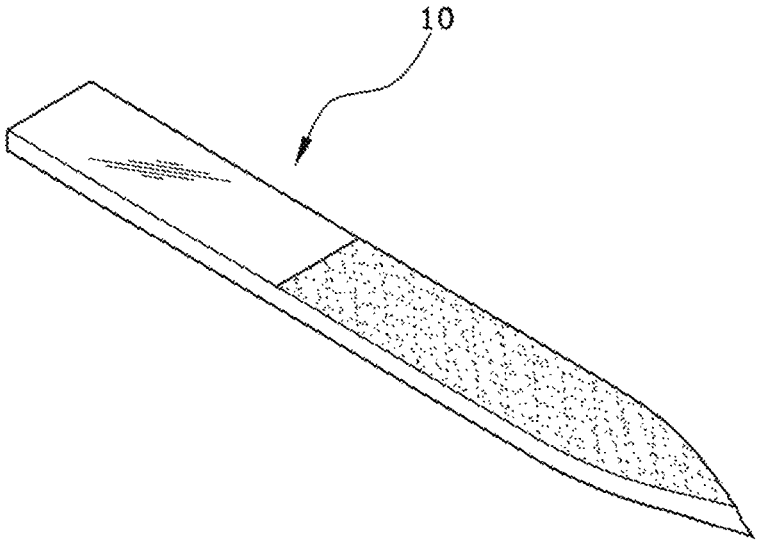
FIG. 3 is a diagram illustrating a nail file having a plate made of glass according to an embodiment of the present invention.
Figure 4:
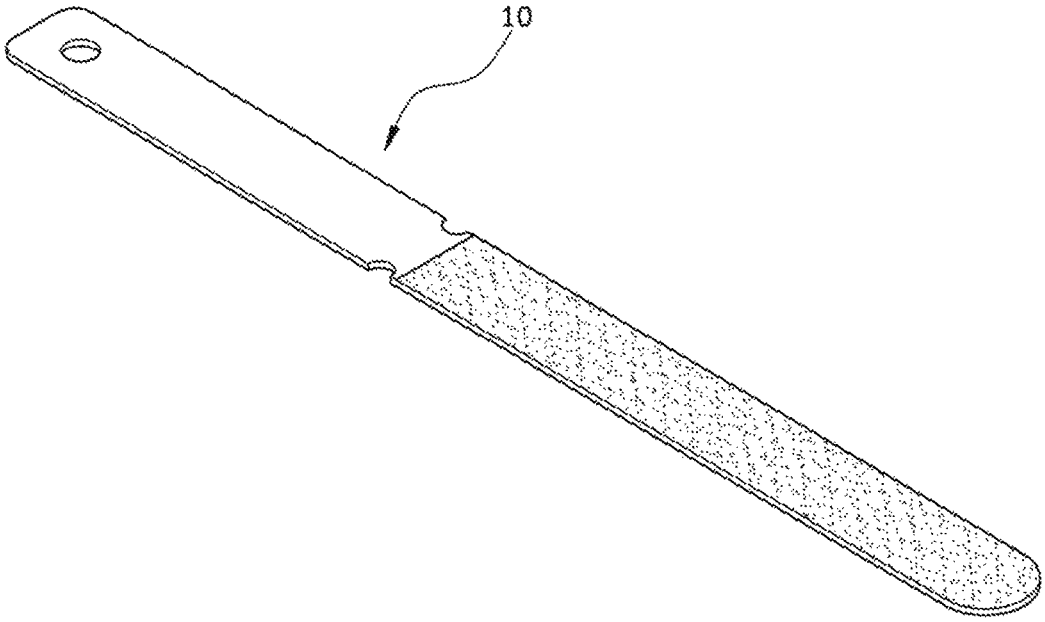
FIG. 4 is a diagram illustrating a nail file having a plate made of a thin iron sheet according to another embodiment of the present invention.

In the following description, the structural or functional description specified to exemplary embodiments according to the concept of the present invention is intended to describe the exemplary embodiments, so it should be understood that the present invention may be variously embodied, without being limited to the exemplary embodiments. The exemplary embodiments according to the concept of the present invention may be variously modified and may have various shapes, so examples of which are illustrated in the accompanying drawings and will be described in detail with reference to the accompanying drawings. However, it should be understood that the exemplary embodiments according to the concept of the present invention are not limited to the embodiments which will be described hereinbelow with reference to the accompanying drawings, but various modifications, equivalents, additions and substitutions are possible, without departing from the scope and spirit of the invention. Further, it should be noted that the terms and words used in the specification and the claims should not be construed as being limited to ordinary meanings or dictionary definitions. Meanwhile, the embodiments described in the specification and the configurations illustrated in the drawings are merely examples and do not exhaustively present the technical spirit of the present invention. Accordingly, it should be appreciated that there may be various equivalents and modifications that can replace the embodiments and the configurations at the time at which the present application is filed.

In the following description, unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinbelow, exemplary embodiments of the present invention will be described in detail with reference to the accompanying drawings.

First Embodiment

First, for performing the present invention, powder particles were prepared. The powder particles are capable of expressing various colors, so powder paint having desired colors may be provided.

Prepared powder paint used as the powder particles was put into a BC solution known as an epoxy retarder to dissolve the powder paint therein (powder particles dissolving step; S10).

The powder paint can express desired color on a surface of a plate 10.

Liquefied powder which was dissolved powder obtained from the powder particles dissolving step S10, was mixed with epoxy resin in an epoxy resin and powder mixing step S20 whereby a mixture was obtained.

In application step S30, the obtained mixture was a liquid mixture and was applied to the surface of the plate 10 by a rolling method using rollers, etc, thereby forming an application layer.

In the application step S30, a pad printing method may be used instead of applying by the rolling method using rollers, etc, and it is preferred an application thickness of the mixture is in a range of 20 to 40 μm in the present invention.

In the present invention, it is required to apply the mixture by the rolling method or the pad printing method. However, a spreading method using a spray is not suitable.

The rolling method is used to maintain an appropriate application thickness of a liquid mixture when applying the mixture to the surface of the plate.

In a case of when the application thickness of the mixture is equal to or greater than 60 μm, abrasives permeate to the application layer, whereby abrasion efficiency of the abrasives decreases. Accordingly, application thickness of the mixture is preferentially set to the range of 20 to 40 μm.

Thereafter, the plate obtained from the application step S30 was fired by heating the plate at 150° C. for 10 to 15 seconds in a first firing step S40.

In the first firing step S40, the powder was dissolved on the surface of the plate 10, so the mixture was maintained in a strong bonded state with the epoxy resin. In an abrasives spreading step S50, abrasives in a range from 150 mesh to 320 mesh were spread to the upper and lower surfaces of the plate 10.

In a second firing step S60, the plate obtained from the abrasive spreading step S50 was fired at a temperature range of 190° C. to 200° C. for 12 minutes.

Here, the plate 10 may be made of glass or a thin iron sheet, etc.

It is required to consider the characteristics of the material of the plate 10 and the abrasives spread on the surface of the plate which were fired after the mixture obtained from the epoxy resin and powder mixing step S20 was applied to the surface of the plate 10. Further, it is required evenly distribute the abrasives on the plate, and to prevent the abrasives from being stripped off the plate when using the nail file.

To this end, in an epoxy resin coating step S70 of coating the upper and lower surfaces of the plate obtained from the second firing step S60 with a thin epoxy resin, surfaces of the plate were coated with the epoxy resin, and then the surfaces of the plate were coated again with silicone oil, etc in a silicone oil coating step S80.

When performing the silicone oil coating step S80, dead skin cells are prevented from being caught between the abrasives adhered to the surfaces of the plate 10, and removal of foreign materials such as dead skin cells from the surfaces of the plate 10 is easy.

Although the present invention is provided by application of the mixture of epoxy resin and powder to the upper and lower surfaces of the plate 10, the present invention may be realized by applying the mixture to any one of the upper and lower surfaces of the plate 10 (application step S30), prior to performing the first firing step S40, the abrasive spreading step S50, and the second firing step S60, and then performing the same steps on a remaining one of the upper and lower surfaces of the plate 10.

Performing procedures such as, performing the application step S30 to the second firing step S60 to any one of the upper and lower surfaces of the plate 10 and then repeating the same steps on the remaining one surface of the plate 10, or performing the application step S30 to the second firing step S60 to the upper and lower surfaces of the plate 10 at the same time may be freely selected according to a work environment, etc.

In addition, as described above, the plate 10 in the present invention is made of glass or a thin iron sheet, and it is preferred that abrasives are adhered to and evenly distributed on the surface of the plate 10.

For this, after applying the mixture obtained from the powder particles dissolving step S10 and the epoxy resin and powder mixing step S20 to the surface of the plate 10, abrasives may be spread on the surface of the plate 10 obtained from the first firing step, and the mixture applied to the surface of the plate 10 is dissolved and makes the abrasives spread evenly and strongly in the second firing step S60.

On the other hand, although abrasives having same particle size may be spread on the upper and lower surfaces of the plate 10, the product of the present invention may be obtained by spreading abrasives having different particle sizes to the upper and lower surfaces of the plate.

For example, to make any one of or both the upper and lower surfaces of the plate 10 be relatively rough, abrasives about 220 mesh may be spread prior to performing follow-up steps.

Furthermore, it is possible to spread abrasives of 220 mesh to any one of the upper and lower surfaces of the plate 10 to form a relatively rough surface and to spread abrasives of 280 mesh to a remaining one surface of the plate 10 to form a relatively fine surface, and follow-up steps are performed. Like this, the roughness of the surfaces of the plate 10 may be selected by a manufacturer in a certain range of particles sizes.

However, when selecting the abrasives, it is required to apply abrasives having the same size to one surface of the plate 10 to achieve the object of the present invention.

In other words, in the present invention, it is required to spread abrasives having a uniform size to a surface of the plate 10. In the case of using abrasives having irregular sizes, abrasives may be stripped off the plate 10 when using the nail file and the reliability of the product may be decreased.

Second Embodiment

The method of manufacturing the nail file of the present invention may be performed by the second embodiment configured differently from the first embodiment.

The method of the second embodiment is performed by the following steps:

an abrasives and powder particles mixing step S100 of mixing abrasives comprising of rock dust with powder particles;

a glue preparing step S200 of mixing epoxy ink, epoxy hardener, and Acron dry paint together to obtain glue;

a first application step S300 of applying the glue obtained from the glue preparing step S200 on a first one of upper and lower surfaces of a plate 10 and applying the mixture of abrasives and powder particles obtained from the abrasives and powder particles mixing step S100 to the first surface;

a first firing step S400 of putting the plate 10 obtained from the first application step S300 into a furnace and firing the plate at 180° C. for 12 minutes;

a second application step S500 of applying the glue obtained from the glue preparing step S200 on a second one of the upper and lower surfaces of the plate 10 obtained from the first firing step S400 and applying the mixture of abrasives and powder particles obtained from the abrasives and powder particles mixing step S100 to the second surface;

a second firing step S600 of putting the plate 10 obtained from the second application step S500 into the furnace and firing the plate at 180° C. for 12 minutes;

an epoxy resin coating step S700 of coating the upper and lower surfaces of the plate 10 obtained from the second firing step S600 with thin epoxy resin; and a third firing step S800 of putting the plate 10 obtained from the epoxy resin coating step S700 into the furnace and firing the plate 10 at 180° C. for 12 minutes and cooling the plate at room temperature.

At the abrasives and powder particles mixing step S100, abrasives in a range from 220 mesh to 280 mesh and color powder particles were mixed at a ratio of 10:1. Various color expression realized by the color expression of powder particles may provide desired visual beauty.

The glue preparing step S200 was performed to prepare glue by mixing epoxy ink, epoxy hardener, and Acron dry paint at a ratio of 5:1:3.

Herein, Acron 2000 typically used in the art is used as the Acron dry paint. The Acron 2000 comprising of acryl resin, melamine resin, and epoxy resin as main components is one-component-type heat drying paint, and has excellent properties of adhesion to materials, chemical resistance, water resistance, corrosion resistance, hardness, glossiness, and maintenance rate thereof.

By using the Acron dry paint in the present invention, filed surfaces of a nail may be prevented from being dug deeply or grooved.

On the other hand, it is preferable to differentiate roughness of the opposite surfaces of the nail file by spreading abrasives of 220 mesh at the first application step S300 and by spreading abrasives of 280 mesh at the second application step S500.

At the epoxy resin coating step S700, it is preferred that the plate 10 obtained from the second firing step S600 is coated by a dipping method with coating liquid prepared by mixing an epoxy resin, epoxy hardener, epoxy retarder, and an epoxy thinner at a ratio of 10:5:2:1.

After obtaining a finished plate product from the third firing step S800 and cooling the product at room temperature, a plate surface treatment step S900 may be additionally performed to apply a surface treatment agent comprised of wax and silicone oil to the upper and lower surfaces of the plate 10.

In this case, when applying wax and silicone oil to the upper and lower surfaces of the plate 10 as described above, dead skin cells may be prevented from being caught between the abrasives when filing fingernails or toenails. Further, even when dead skin cells are jammed between the abrasives, the dead skin cells may be easily removed.

In the second embodiment of the present invention, the plate 10 may be made of a thin iron sheet or glass as described for the first embodiment.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A method of manufacturing a nail file, the method comprising:

a powder particles dissolving step (S10) of dissolving powder particles in a prepared BC solution;

an epoxy resin and powder mixing step (S20) of mixing liquefied powder obtained from the powder particles dissolving step (S10) with an epoxy resin;

an application step (S30) of applying a mixture obtained from the epoxy resin and powder mixing step (S20) to upper and lower surfaces of a plate by a rolling method;

a first firing step (S40) of firing the plate obtained from the application step (S30) by heating the plate at 150° C. for 10 to 15 seconds;

an abrasives spreading step (S50) of spreading abrasives in a range from 150 mesh to 320 mesh to each of the upper and lower surfaces of the plate obtained from the first firing step (S40);

a second firing step (S60) of firing the plate obtained from the abrasives spreading step (S50) at a temperature range of 190° C. to 200° C. for 12 minutes; and an epoxy resin coating step (S70) of coating the upper and lower surfaces of the plate obtained from the second firing step (S60) with a thin epoxy resin.

2. The method according to claim 1, wherein an application thickness of the mixture applied to the plate at the application step (S30) is 20 to 40 μm.

3. The method according to claim 1, wherein the surfaces of the plate (10) have different roughness due to spreading abrasives of 220 mesh to any one of the upper and lower surfaces of the plate and spreading abrasives of 280 mesh to a remaining one surface.

4. The method according to claim 1, wherein the plate (10) is made of glass or a thin iron sheet.

5. A method of manufacturing a nail file, the method comprising:

a powder particles dissolving step (S10) of dissolving powder particles in a prepared BC solution;

an epoxy resin and powder mixing step (S20) of mixing liquefied powder obtained from the powder particles dissolving step (S10) with an epoxy resin;

an application step (S30) of applying a mixture obtained from the epoxy resin and powder mixing step (S20) to any one of upper and lower surfaces of a plate by a rolling method;

a first firing step (S40) of firing the plate obtained from the application step (S30) by heating the plate at 150° C. for 10 to 15 seconds;

an abrasives spreading step (S50) of spreading abrasives in a range from 150 mesh to 320 mesh to the surface of the plate obtained from the first firing step (S40);

a second firing step (S60) of firing the plate obtained from the abrasives spreading step (S50) at a temperature range of 190° C. to 200° C. for 12 minutes; and an epoxy resin coating step (S70) of coating the upper and lower surfaces of the plate with a thin epoxy resin after repeating the application step (S30), the first firing step (S40), the abrasives spreading step (S50), and the second firing step (S60) to a remaining one of the upper and lower surfaces of the plate obtained from the second firing step (S60).

6. The method according to claim 5, wherein an application thickness of the mixture applied to the plate at the application step (S30) is 20 to 40 μm.

7. The method according to claim 5, wherein the surfaces of the plate (10) have different roughness due to spreading abrasives of 220 mesh to any one of the upper and lower surfaces of the plate and spreading abrasives of 280 mesh to a remaining one surface.

8. The method according to claim 5, wherein the plate (10) is made of glass or a thin iron sheet.

9. A method of manufacturing a nail file, the method comprising:

an abrasives and powder particles mixing step (S100) of mixing abrasives comprising rock dust with powder particles;

a glue preparing step (S200) of mixing an epoxy ink, an epoxy hardener, and an Acron dry paint to prepare a glue;

a first application step (S300) of applying the glue obtained from the glue preparing step (S200) on a first one of upper and lower surfaces of a plate (10) and applying a mixture of the abrasives and powder particles obtained from the abrasives and powder particles mixing step (S100) to the first surface;

a first firing step (S400) of putting the plate (10) obtained from the first application step (S300) into a furnace and firing the plate at 180° C. for 12 minutes;

a second application step (S500) of applying the glue obtained from the glue preparing step (S200) on a second one of the upper and lower surfaces of the plate obtained from the first firing step (S400) and applying the mixture of the abrasives and powder particles obtained from the abrasives and powder particles mixing step (S100) to the second surface;

a second firing step (S600) of putting the plate (10) obtained from the second application step (S500) into the furnace and firing the plate at 180° C. for 12 minutes;

an epoxy resin coating step (S700) of coating the upper and lower surfaces of the plate obtained from the second firing step (S600) with a thin epoxy resin;

a third firing step (S800) of putting the plate obtained from the epoxy resin coating step (S700) into the furnace and firing the plate at 180° C. for 12 minutes; and cooling the plate at room temperature.

10. The method according to claim 9, wherein at the abrasives and powder particles mixing step (S100), abrasives in a range of 220 mesh to 280 mesh and color powder particles are mixed together at a ratio of 10:1.

11. The method according to claim 9, wherein at the epoxy resin coating step (S700), the plate (10) obtained from the second firing step (S600) is coated with a coating liquid prepared by mixing an epoxy resin, an epoxy hardener, an epoxy retarder, and an epoxy thinner together at a ratio of 10:5:2:1.

12. The method according to claim 10, further comprising: a plate surface treatment step (S900) of applying a surface treatment agent comprised of wax and silicone oil to the upper and lower surfaces of the plate (10) after obtaining a plate product by cooling the plate obtained from the third firing step (S800) at room temperature.

13. The method according to claim 9, wherein the plate (10) is made of glass or a thin iron sheet.

* * * * *